United States Patent [19]

DeSalle

[11] 4,215,970

[45] Aug. 5, 1980

[54] ROLL LOADER FOR ROLL MANIPULATING MACHINE

[76] Inventor: Eugene J. DeSalle, 216 Shawnee Ave., Monessen, Pa. 15062

[21] Appl. No.: 917,563

[22] Filed: Jun. 21, 1978

[51] Int. Cl.[2] ..... B65H 75/02

[52] U.S. Cl. ..... 414/684; 198/489; 242/58.6; 414/911

[58] Field of Search ..... 414/684, 680, 745, 911, 414/595; 198/489, 535, 536, 539, 600; 242/58.6, 79

[56] References Cited

U.S. PATENT DOCUMENTS

| | | | |
|---|---|---|---|
| 1,677,561 | 7/1928 | Lamatsch | 242/58.6 |
| 2,413,767 | 1/1947 | Hyde | 198/489 |
| 2,789,707 | 4/1957 | Wolf | 414/546 |
| 3,458,147 | 7/1969 | Teske | 242/58.6 X |

*Primary Examiner*—Robert G. Sheridan
*Assistant Examiner*—George F. Abraham
*Attorney, Agent, or Firm*—Carothers and Carothers

[57] ABSTRACT

A roll, such as a cloth bolt, loader for a roll manipulating machine, such as a cloth spreader, which includes a pair of horizontally spaced lifting arms mounted to a frame and adapted to receive a shaft supporting a roll for elevation. The lifting arms are raised in unison such that the roll is elevated until the support shaft thereof engages a pair of horizontally spaced guide rails. The guide rails terminate on a down slope such that the roll and roll support shaft are transferred from the elevating lifting arms for free movement down the guide rails. The guide rails terminate in bridge tracks which yield downwardly under the weight of the roll and its support shaft for transfer of the roll support shaft down onto an underlying roll support of a roll manipulating machine.

12 Claims, 2 Drawing Figures

ROLL LOADER FOR ROLL MANIPULATING MACHINE

BACKGROUND OF THE INVENTION

This invention relates generally to elevators and more particularly to a loader for elevating rolls or other material carried on a shaft and for depositing the material on a support at an elevated position for further manipulation of the material.

In the clothing manufacturing industry, automatic cloth spreading machines which are situated on top of large elongated work or cutting tables, feed a web of material from a bolt of cloth and automatically spread the material in layers on top of the cutting table. Pattern cutters thereafter cut patterns for clothing from the multiple layers of material.

The automatic cloth spreading machine spreads the cloth in layers by moving back and forth on the cutting table while feeding the material from the bolt of cloth mounted on the spreader machine. These bolts of cloth are relatively heavy, in the neighborhood of 150 to 300 pounds, and it thus requires the manual labor of at least two strong individuals in order to lift the cloth bolt and load it in its elevated position onto the bolt support of the automatic cloth spreader.

It is the principle object of the present invention to eliminate this requirement for manual labor to load the cloth bolt onto the automatic cloth spreader by providing an automatic bolt loader which is also moveably mounted on the cutting table as is the cloth spreader.

SUMMARY OF THE INVENTION

The roll loader of the present invention generally comprises a frame with a pair of horizontally spaced lifting arms mounted on the frame and adapted to receive a roll support shaft thereon for elevation. Means are provided to raise the arms in unison together with the support shaft resting on the arm and a roll in turn supported on the shaft between the arms. A pair of horizontally spaced bridge tracks are also mounted to the frame at an elevated position and yield downwardly under the weight of the roll support shaft together with the roll load carried thereon in order to transfer the shaft and load to the roll shaft support of an underlying roll manipulating machine. Guide means are provided on the frame for the gravity transfer of the roll support shaft from the lifting arms at a predetermined elevation onto the bridge tracks.

This guide means for transfer of the roll support shaft from the elevated lifting arms to the bridge tracks is preferably in the form of horizontally spaced guide rails which are positioned to receive the support shaft in sliding or rolling engagement while the lifting arms are elevating the shaft. These rails terminate on a down slope thereby permitting free gravity transfer of the support shaft from the lifting arms for free rolling down the rails onto the bridge track, which yield under the load and thereby contact the roll shaft support of the underlying roll manipulating machine to permit free rolling transfer of the roll shaft from the guide rails into the machine roll support. Once the roll and its support shaft are loaded onto the manipulating machine, the yielding qualities of the bridge tracks cause them to again rise out of contact with the manipulating machine so that the machine is then free of the loader to function in its expected manner for manipulating the loaded material.

In its simplest form, the lifting arms are provided in the form of pivot arms and a pair of cables are respectively attached to the free ends of the lifting arms. These cables are threaded over idler pulleys and the other ends of the cables are secured to a single take-up reel that is driven by a motor mounted on the frame to raise and lower the lifting arms in unison as required. Limit switches may also be provided on the frame for engagement by at least one of the lifting arms to automatically stop the motor when the arms have pivoted to a predetermined limit of elevation or descent. In order to keep the cables taut, springs may be secured between the lifting arms and the frame.

In one form, the bridge tracks are provided as rigid members which are pivotally secured for vertical movement to the frame at the terminal ends of the guide rail down slopes and a compression spring supports the rigid members from the frame to provide the downward yielding capabilities of the bridge tracks.

As the loader of the present invention was primarily conceived for use with automatic cloth spreading machines in the clothing industry, the frame is thus generally provided with wheels for longitudinal movement of the loader along a textile or fabric cutting table for cooperative use with an automatic cloth spreading machine mounted for movement on the same table. Stop means are provided to prevent movement of the loader relative to the cutting table and spreading machine during loading operations.

BRIEF DESCRIPTION OF THE DRAWINGS

Other objects and advantages appear in the following description and claims.

The accompanying drawings show, for the purpose of exemplification without limiting the invention or the claims thereto, certain practical embodiments illustrating the principles of this invention wherein:

DETAILED DESCRIPTION OF THE PREFERRED EMBODIMENT

Figure 1:
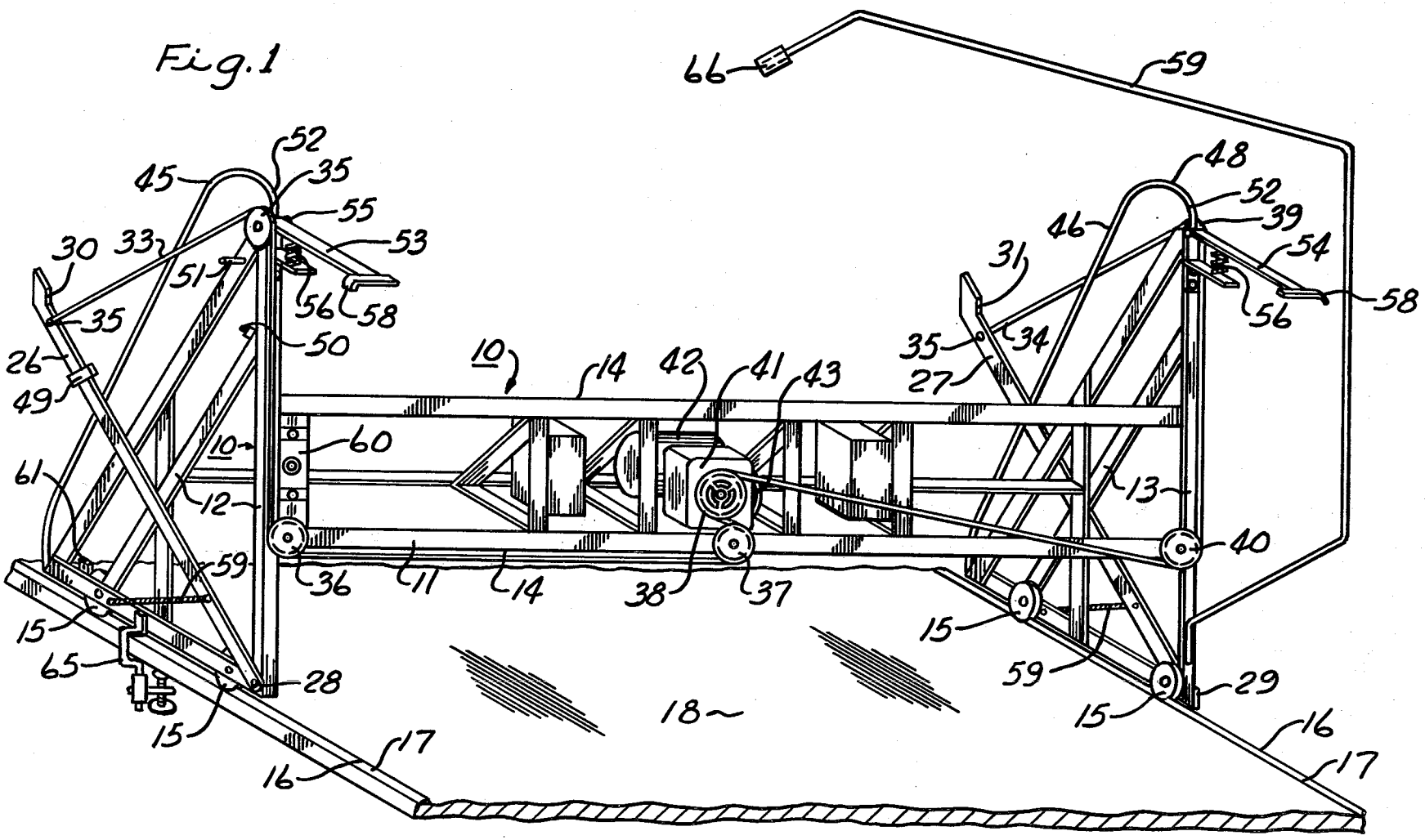
FIG. 1 is a perspective view of one embodiment of the roll loader of the present invention mounted on an elongated work table.

Referring to the drawings, the bolt loader 10 of the present invention generally consists of a frame 11 constructed of angle iron or any other suitable material. Frame 11 consists of two horizontally spaced triangular-shaped end frame sections 12 and 13 which are secured together by cross frame 14. The frame 11 is supported by and rides on the four wheels 15. Wheels 15 are provided with annular grooves about their perimeter to receive corresponding track ribs 16 of tracks 17. Tracks 17 are in turn secured to both longitudinal side edges of the top of elongated cutting table 18. These longitudinal tracks 17 are primarily provided for the travel of the automatic cloth spreading machine 19 along cutting table 18. Automatic cloth spreading machine 19 is a conventional machine which may, for example, be purchased on the market under the trademark CRA. The machine is also provided with wheels 20 which ride on tracks 17.

Automatic spreading machine 19 is not shown in FIG. 1 in order to fully expose the front of the loader 10 of the present invention. Roll loader 10 and automatic cloth spreading machine 19 roll along tracks 17 independent of each other.

Figure 2:
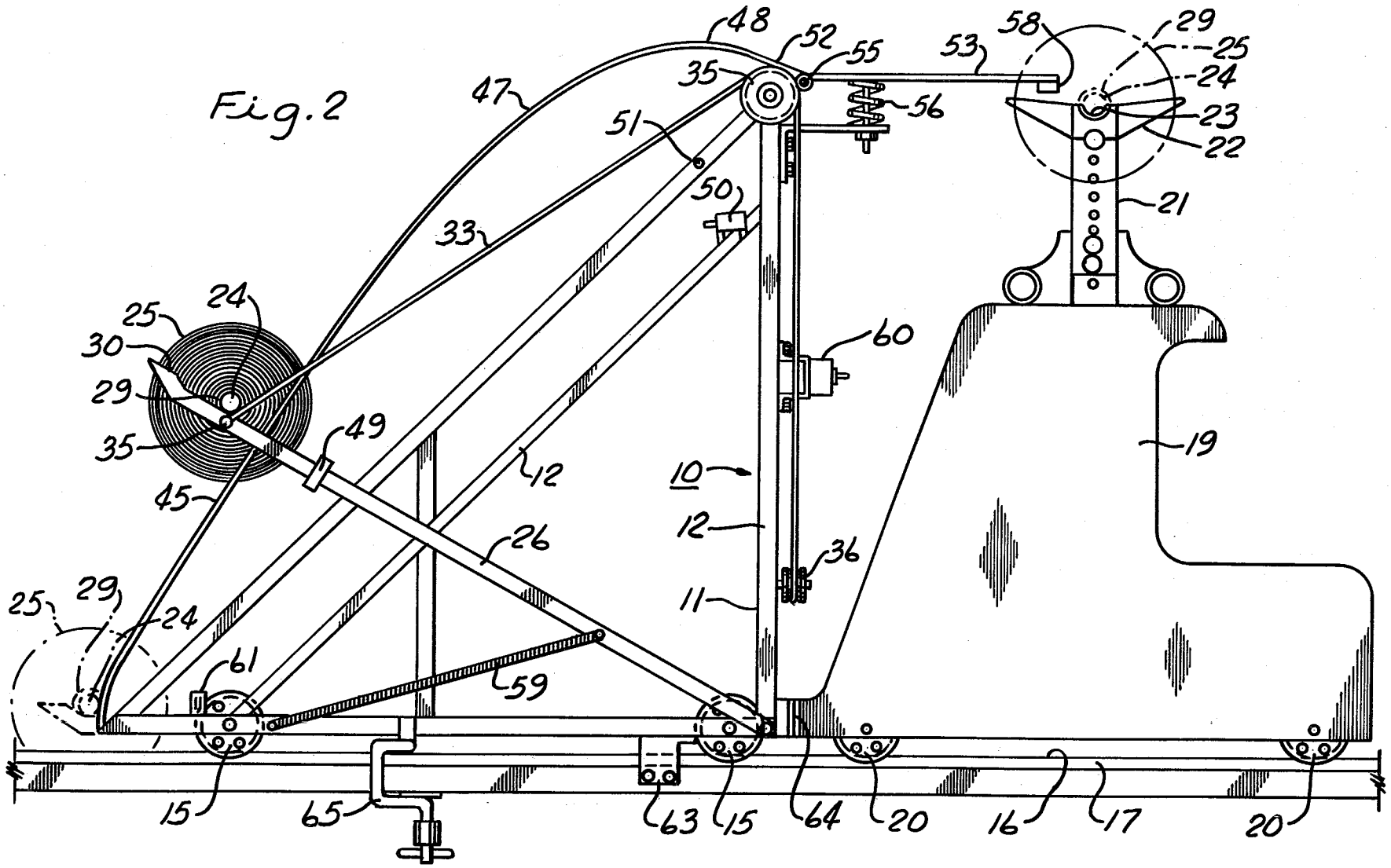
FIG. 2 is a view in side elevation of the roll loader illustrated in FIG. 1.

Referring particularly to FIG. 2, automatic spreading machine 19 is provided with two upward or vertically extending standards or supports 21 which are horizontally spaced from each other on opposite sides of the cutting table 18. These standards 21 are each provided with a cradle 22 at the top portions thereof. Cradles 22 are provided with center notches 23 which act as roll shaft supports and receive opposite ends of a roll support shaft 24 illustrated in dashed outline. Support shaft 24 in turn supports the cloth bolt 25, also illustrated in dashed outline, between the standards 21.

The leading edge of the web of fabric from bolt 25 is threaded or weaved in a conventional manner into automatic spreading machine 19. Automatic spreading machine 19 thereafter travels back and forth along elongated cutting table 18 and lays down the fabric web in multiple layers for subsequent fabric pattern cutting by fabric cutters.

Returning to the loader 10 of the present invention which loads the cloth bolts 25 into the cradles or shaft supports 22 of the fabric spreading machine 19, a pair of horizontally spaced lifting arms 26 and 27 are pivotally secured respectively at 28 and 29 to frame 11. The free ends 30 and 31 respectively of lifting arms 26 and 27 are provided with upturned dogs or projections to receive the opposite ends of a roll support bar or shaft thereover and to prevent the same from rolling off the lifting arms 26 and 27 when the lifting arms initially pick up or elevate a roll support shaft from the table 18 together with its roll or cloth bolt load.

An initial supply of cloth bolts or rolls are usually positioned on the cutting table 18 behind or to the left of loader 10 as depicted in FIG. 2. A roll support shaft 24 is inserted through the core of the bolt 25 and centered and secured to the core or eye of the bolt by conventional annular conical core supports 29 which are coaxially received over the support shaft and tightly engage in opposite ends of the tubular bolt core. The combined cloth bolt and support shaft are thus in ready position for further positioning and manipulation by loader 10.

The lifting arms 26 and 27 of loader 10 are raised or lowered in unison by means of the cables 33 and 34, respectively, which are connected to the free ends of the lifting arms as indicated at 35 and 36.

Cable 33 is threaded over a series of idler pulleys 35, 36 and 37, and the other end of the cable 33 is secured to take-up reel 38. In a similar manner, cable 34 is threaded over idler pulleys 39 and 40 and the other or opposite end of cable 34 is also attached to the same take-up reel 38. Take-up reel 38 is driven through gear box 41 by motor 42 via the belt drive 43. Electric motor 42 is operable in either direction to raise or lower lifting arms 26 and 27 in unison by either winding or unwinding cables 33 and 34 simultaneously on take-up reel 38.

In the figures, lifting arms 26 and 27 are illustrated in a partially elevated position. However, for initial operation of loader 10, the arms 26 and 27 are fully lowered so that they are in contact with cutting table 18. In this position, the previously described bolt of material or fabric together with its mounted support shaft is slid or rolled into position over top of dogs 30 and 31 such that the opposite ends of the roll support shaft 24 overlie arms 26 and 27 between dogs 30 and 31 and cable attachment points 35 and 36.

A pair of horizontally spaced guide rails 45 and 46 are rigidly secured to frame 11 and positioned to receive roll support shaft 24 in sliding and/or rolling engagement while the arms 26 and 27 are elevating. Once the roll support shaft 24 has been positioned over dogs 30 and 31 while arms 26 and 27 are lying against table 18, motor 42 is energized to rotate in the up position and lifting arms 26 and 27 accordingly begin to elevate in unison and then contact roll support shaft 24, at which point roll support shaft 24 together with cloth bolt 25 also begins to elevate with arms 26 and 27. Arms 26 and 27 thus continue to elevate roll support shaft 24, and at a predetermined point of elevation, roll support shaft 24 contacts guide rails or tracks 45 and 46 on opposite ends of the shaft in sliding and/or rolling engagement. This point of elevation is generally indicated at 47 on guide rails 45 and 46.

At this point, lifting arms 26 and 27 continue to elevate in unison and to slide roll support shaft 24 up the horizontally spaced tracks 45 and 46 until shaft 24 reaches the crest 48 of guide tracks 45 and 46. At this point, contact plate 49 secured to lifting arm 26 contacts limit switch 50 and thereby shuts down electric motor 42. In order to prevent undue coasting of the motor 42 after this limit switch has been tripped, stop 51 is engaged by lifting arm 26.

At this position of elevation, the momentum of support shaft 24 causes it to leave contact with lifting arms 26 and 27 and to roll down the down slope terminating portions 52 of guide rails or tracks 45 and 46.

The down slopes of the guide rails terminate in bridge tracks 53 and 54 which yield downwardly under the weight of the support shaft 24 and its cloth bolt load for free rolling transfer of the support shaft 24 down onto the underlying cradle supports 22 of cloth spreading machine 19, such that support shaft 24 rolls freely into notches 23 of the cradles.

Bridge tracks 53 and 54 are rigid members which are pivotally secured to the frame 11 at the end of the respective guide rails 45 and 46 as indicated at 55. Compression spring 56 support the rigid bridge members 53 and 54 respectively from frame 11 to provide the downward yielding capabilities of the bridge tracks. Thus, when the support shaft 24 rolls down slopes 52 of the guide rails, and rolls out onto bridge tracks 53 and 54, compression springs 56 compress under the weight of the shaft and bolt of material until contacts 58 on the ends of the bridge tracks engage in rest on cradles or shaft supports 22 of the spreading machine. This permits support shaft 24 together with its supported roll or bolt to continue to roll downhill on bridge tracks 53 and 54 into cradles 22. Once the support shaft 24 has made contact with the cradles 22, compression spring 56 lift bridge tracks 53 and 54 about their pivot points 55 so that the bridge tracks clear contact with automatic spreading machine 19. Automatic spreading machine 19 is then ready to be threaded with the leading edge of the web of material from bolt 25 and the machine 19 is then operated independent of loader 10 in the conventional manner.

In order to maintain lifting cables 33 and 34 taut at all times so that they do not jump off their respective idler pulleys, tension springs 59 are secured between each of the lifting arms and frame 11 to maintain the lifting cables under continuous tension.

In order to lower lifting arms 26 and 27 to their down position to receive the next support shaft and cloth bolt, switch 60 is switched to the down position and motor 42 is energized in the opposite direction to feed cables from take-up reel 38 so that the lifting arms are lowered in unison. When lifting arms 26 and 27 reach the down position in contact with or close to table 18, limit switch 61 is engaged by contact plate 49 on lifting arm 26 to stop the motor 42.

During the loading operation, stop 63 is positioned on track 17 in engagement with one of the support wheels 15 of the loader to prevent the loader from drifting to the left as seen in FIG. 2. The loader is prevented from moving to the right in the Figure as it is moved up in engagement or close engagement with the spreading machine 19 as indicated in FIG. 2 such that bumper 64 either engages or is in close proximity to the adjacent side of spreading machine 19.

Clamp 65 is also provided on one side of the frame 11 to clamp the frame to the cutting table 18. This clamp prevents any unanticipated tipping of the loader relative to table 18.

Power is supplied to electric motor 42 via the power mast 59 which is attached to the side of frame 11 as illustrated in FIG. 1. Power mast 59 is a conduit rigidly attached to the frame of the loader and contains electrical conductors for the supply to the electrical components of the loader from an overhead buss bar (not shown) to which trolley 66 is attached in order to provide continuous electrical power feed to the loader no matter what position the loader is moved to along table 18.

I claim:

1. A roll loader for a roll manipulating machine comprising, a frame, a pair of horizontally spaced lifting arms mounted on said frame and adapted to receive a roll support shaft thereon for elevation, means to raise said arms in unison, a pair of horizontally spaced guide rails positioned to receive a roll support shaft in sliding or rolling engagement at a predetermined elevation while it is being elevated by said arms, said rails rise on an incline and crest to a terminating down slope to permit free transfer of a roll support shaft from said arms for free rolling down said rails, said rail down slopes terminating in bridge tracks which yield downwardly under the weight of a roll support shaft rolling from said rail down slopes onto said bridge tracks for transfer down onto an underlying roll shaft support of a roll manipulating machine.

2. The roll loader of claim 1, wherein said bridge tracks are rigid members pivotally secured for vertical movement to said frame, and compression springs supporting said rigid members from said frame to provide said downward yield.

3. The roll loader of claim 1, including wheels on said frame for longitudinal movement thereof on an elongated table.

4. The roll loader of claim 1 including clamp means to temporarily prevent movement of said frame relative to a table.

5. A bolt loader for cloth spreading machines comprising, a frame, a pair of horizontally spaced lifting arms pivoted at one end to said frame and adapted to receive a roll support shaft at their free ends for elevation, means to pivotally raise and lower said arms in unison, a pair of horizontally spaced guide rails positioned to receive said shaft in sliding or rolling engagement while said arms are elevating, said rails terminating on a down slope to permit gravity transfer of said shaft from said arms for free rolling of said shaft down said rails, the down slope of said rails each terminating in bridge tracks which yield downwardly under the weight of said shaft for free rolling of said shaft down onto the roll shaft support of a material spreading machine.

6. The bolt loader of claim 5, wherein said rails rise on an incline and crest to said down slope terminations.

7. The bolt loader of claim 6, said means to raise and lower said arms consisting of a pair of cables respectively attached at one end to the free ends of said arms and threaded over idler pulley means with their other ends secured to a take-up reel driven by a motor mounted on said frame to raise and lower said arms.

8. The bolt loader of claim 7, including limit switch means mounted on said frame for engagement by at least one of said arms to automatically stop said motor when said arms have been pivoted to a predetermined limit.

9. The bolt loader of claim 7, including spring means secured between each of said arms and said frame to maintain said cables taut.

10. The bolt loader of claim 5, wherein said bridge tracks are rigid members pivotally secured for vertical movement to the terminal ends of said rail down slopes, and compression springs supporting said rigid members from said frame to provide said downward yield.

11. The bolt loader of claim 5, including wheels on said frame for longitudinal movement thereof on an elongated cloth spreader table.

12. The bolt loader of claim 11, including clamp means to temporarily prevent movement of said frame relative to a table.

* * * * *